US005452555A

United States Patent [19]

Lee

[11] Patent Number: 5,452,555

[45] Date of Patent: Sep. 26, 1995

[54] METHOD AND APPARATUS FOR ASSEMBLING MULTIPLE WALL SEGMENTS INTO A CURVED CONFIGURATION

[75] Inventor: D. Rick Lee, Bastrop, Tex.

[73] Assignee: The Board of Regents of the University of Texas System, Austin, Tex.

[21] Appl. No.: 115,418

[22] Filed: Sep. 1, 1993

[51] Int. Cl.[6] ..... E04B 1/32; E04C 2/38; E04G 21/14

[52] U.S. Cl. ..... 52/584.1; 52/81.4; 52/745.08; 403/388

[58] Field of Search ..... 411/171, 537, 411/538, 546, 547; 403/408.1, 388; 52/81.1, 81.2, 81.3, 81.4, 81.5, 82, 63, 83, 126.1, 584.1, 745.08, 745.07, 745.06, 745.05, 815

[56] References Cited

U.S. PATENT DOCUMENTS

| | | | |
|---|---|---|---|
| 1,665,431 | 4/1928 | Barclay | 160/369 |
| 2,202,405 | 5/1940 | Smith | 411/171 |
| 2,440,449 | 4/1948 | Raemer | 52/82 |
| 2,943,716 | 7/1960 | Babcock | 52/126.1 |
| 3,332,178 | 7/1967 | Foster . | |
| 3,530,621 | 9/1970 | Rutzebeck | 52/81.3 |
| 3,945,160 | 3/1976 | Grosser et al. | 52/81.4 |
| 4,009,543 | 3/1977 | Smrt . | |
| 4,287,690 | 9/1981 | Berger et al. . | |
| 4,309,852 | 1/1982 | Stolpin . | |
| 4,594,026 | 6/1986 | Hauer et al. | 52/81.3 |
| 4,611,441 | 9/1986 | Wickens . | |

FOREIGN PATENT DOCUMENTS

| | | | |
|---|---|---|---|
| 9569 | of 1904 | United Kingdom | 52/11 |

*Primary Examiner*—Michael Safavi
*Attorney, Agent, or Firm*—Rosenblatt & Redano

[57] ABSTRACT

This invention involves a method and apparatus for joining wall segments together into a curved configuration. It is useful in constructing curved walls or domes, such as geodesic domes. More specifically, this invention involves triangular members for assembly into a geodesic dome.

12 Claims, 2 Drawing Sheets

METHOD AND APPARATUS FOR ASSEMBLING MULTIPLE WALL SEGMENTS INTO A CURVED CONFIGURATION

BACKGROUND OF THE INVENTION

1. Field of the Invention

This invention involves a method and apparatus for joining wall segments together into a curved configuration. It is useful in constructing curved walls or domes, such as geodesic domes. More specifically, this invention involves triangular members for assembly into a geodesic dome.

2. Description of the Prior Art

Curved structures, such as geodesic domes, have existed for many years. An inherent difficulty in constructing such structures is that most building materials such as steel girders, cinder blocks, or bricks are shaped with straight outer surfaces that are more suitable for erecting straight walls as opposed to curved outer walls. In order to assemble noncurved wall segments into a curved wall, such as a geodesic dome configuration, prior art construction methods have used hinged configurations such as those disclosed in U.S. Pat. Nos. 4,309,852 and 3,332,178. Such hinged configurations do not provide the structural rigidity that is required in many building applications.

Other prior art construction methods have used screws and straps to assemble wall segments together, as disclosed in U.S. Pat. No. 4,611,441. Such a strap arrangement does not provide good structural rigidity. Other prior art devices have employed tongue and groove arrangements to join structural members, such as that shown in U.S. Pat. No. 4,287,690 or other channel designs, such as that shown in FIG. 22 of U.S. Pat. No. 4,009,543. Such designs require customized fabrication and increase the cost of construction materials.

None of the prior art methods and apparatus provide for the quick field assembly of heavy gauge materials into a curved structure, such as a geodesic dome, wherein the wall segments can be assembled tightly and rigidly.

SUMMARY OF THE INVENTION

One embodiment of the present invention provides a method and apparatus for connecting two wall segments into a curved configuration. Each of the wall segments comprises at least two bolt channels at each end. The two wall segments are placed side by side with a central angled spacer sleeve is placed between the two wall segments and aligned with the bolt channels in each wall segment. The central angled spacer sleeves are wedged and also comprise a bolt channel of substantially equivalent diameter to the wall member bolt channels.

A bolt comprising a bolt head and a threaded end at the opposite end from the bolt head is placed through the bolt channels in the wall segments and the central angled spacer sleeve. A wedged bolt head bevel washer comprising a bolt channel is aligned with the bolt channel at each end of one of the wall members. The bolt passes through the bolt channel of the bolt head bevel washer such that the bolt head is separated from the first wall member by the bolt head bevel washer.

A wedged nut bevel washer comprising a bolt channel of substantially equivalent diameter to the wall member bolt channels is placed over the bolt. A female threaded nut is then threaded onto the threaded end of the bolt such that it is separated from the second wall member by the nut bevel washer. The bolt head bevel washer and nut bevel washer are aligned 180° out of rotational alignment with the central angled spacer sleeve such that when the nuts are tightened, maximum flush surface contact exists between the bolt heads and bolt head bevel washers and between the nuts and nut bevel washers. The angles of the bevel washers and angled sleeve can be varied as a function of the degree of curvature that the wall segments are to be assembled in.

In another apparatus embodiment of the present invention, three wall segments or perimeter members are joined together to form a triangle. Each perimeter member comprises a bolt channel near each end. A wire mesh is attached to each perimeter member such that it covers the surface area of the triangle. These triangular members are then attached to other triangular members using central angled spacer sleeves, nut bevel washers, bolt head bevel washers, nuts and bolts in a structural configuration as described to connect the two wall members.

An advantage of the present invention over prior art construction methods is that these triangular members can be fabricated in the shop and then bolted together in the field. Thus, a geodesic dome can be assembled by bolting together prefabricated triangular members. This construction method provides time and cost efficiencies over prior methods that required more extensive field work. Another advantage of the present invention is that the prefabricated triangular members can be galvanized using a "hot dip" process prior to their shipment to the field.

DESCRIPTION OF THE PREFERRED EMBODIMENTS

Figure 1:
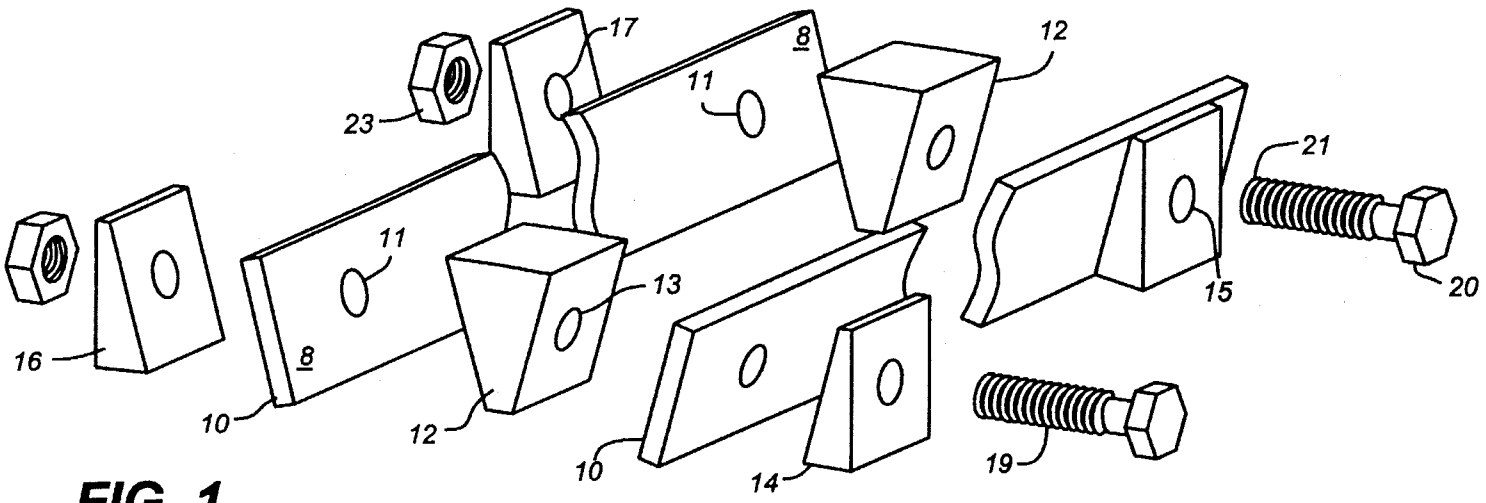
FIG. 1 is an isometric view of a wall segment used in the method embodiment of the present invention.
Figure 2:
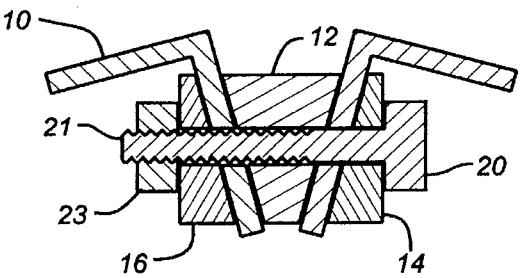
FIG. 2 is a cross-sectional view of an apparatus embodiment of the present invention.

The present invention is directed toward a method and apparatus for use in assembling multiple wall segments into a curved configuration. The present invention provides for connecting two wall segments tightly together. The wall segments may be flat stock or made from angle iron. As shown in FIG. 1, each wall segment 10 of the present invention comprises a flat surface having two ends 8. In a preferred embodiment, the wall segments are made of angle iron, as shown in FIG. 2. Two bolt channels 11 of substantially equivalent diameter are located in the vicinity of each end of each wall segment. In a preferred embodiment a third bolt channel is also located near the center of each wall member. The bolt channels may be round or of a substantially round shape, such as an oval.

As shown in FIGS. 1 and 2, a wedged central angled spacer sleeve 12 is attached to each end of the first wall segment. In a preferred embodiment of the present invention, the central angled spacer sleeves are welded to the first wall segment. In a preferred embodiment, the central angled spacer sleeve is a rectangular tubular member. As shown in FIGS. 1 and 2, each central angled spacer sleeve contains a bolt channel 13 with a diameter substantially equivalent to the diameter of the bolt channels in each wall segment. The central angled spacer sleeves are placed such that their bolt channels are aligned with the respective bolt channel of the first wall segment.

The second wall segment is positioned against the central angled spacer sleeves such that each bolt channel in the second wall segment is aligned with a bolt channel in the first wall segment.

The second wall segment is attached to the first wall segment by a nut and bolt arrangement. As shown in FIGS. 1 and 2, a bolt 19 extends through each set of aligned bolt channels in the vicinity of each end of the wall segments. The bolt comprises a head 20 having an outer radial dimension greater than the diameter of the bolt channels such that the bolt head will not pass through the bolt channels. The bolt further comprises a threaded end 21 opposite the end from the bolt head.

A wedged bolt head bevel washer 14 comprising a bolt channel 15 of substantially equivalent diameter to the bolt channels of the wall segments is positioned between the bolt head and one of the wall segments such that the bolt actually passes through the bolt channel of the bolt head bevel washer.

At the other end of the bolt, a threaded nut 23 is threaded onto the bolt. A wedged nut bevel washer 16 comprising a bolt channel 17 of substantially equivalent diameter to the bolt channels of the wall segments is positioned between the nut and the outer surface of the remaining wall segment such that the bolt passes through the bolt channel in the wedged nut bevel washer. Thus, each bolt passes through the bolt channels in a bolt head bevel washer, one of the wall segments, a central angled spacer sleeve, the other wall segment, and the nut bevel washer. The nut is tightened onto the threaded end of the bolt such that rotational movement of the bolt head bevel washer and the nut bevel washer does not occur.

The central angled spacer sleeve, bolt head bevel washer, and nut bevel washer are all wedged shape. Due to the wedged shape of the shims, one outer surface is thicker than the opposite outer surface. The bolt head and nut bevel washers are rotationally aligned such that their thicker outer surfaces are located at the same azimuth relative to the radial center of the bolt that passes through them. The central angled spacer sleeve is rotationally aligned such that it is 180° out of rotational alignment with the bolt head and nut bevel washers, as shown in FIGS. 1 and 2.

In a method embodiment of the present invention, two wedged central angled spacer sleeves are attached to the first wall segment such that their bolt channels are aligned with the bolt channels of the first wall segment. The second wall segment is then placed into contact with the central angled spacer sleeves such that the bolt channels on the second wall segment are aligned with the bolt channels of the central angled spacer sleeves, as shown in FIGS. 1 and 2.

A wedged bolt head bevel washer is then placed on the outside of either the first or second wall segment such that its bolt channel is aligned with the bolt channels of the wall segments. A bolt, having a bolt head at one end and a threaded end opposite the bolt head, is then passed through the bolt channels of the bolt head bevel washer, the first wall segment, the central angled spacer sleeve, and the second wall segment. A nut bevel washer is then slid over the threaded end of the bolt and a threaded nut is then threaded onto the end of the bolt.

The bolt head bevel washer and nut bevel washer are rotationally oriented such that the nut can be tightened to provide maximum flush surface contact between the bolt head and the bolt head bevel washer, and between the nut and the nut bevel washer, as shown in FIG. 2. These steps are repeated for each set of aligned wall segments and central angled spacer sleeve bolt channels.

In a preferred embodiment, the central angled spacer sleeves can be integrally formed with a wall segment. In another preferred embodiment, the first wall segment can be integrally formed with central angled spacer sleeves on one side and bolt head bevel washers on the opposite side. In another preferred embodiment, the second wall segment can be integrally formed with central angled spacer sleeves on one side and nut bevel washers on the opposite side. In these embodiments, integral formation can be accomplished by methods such as injection molding or casting.

Figure 3:
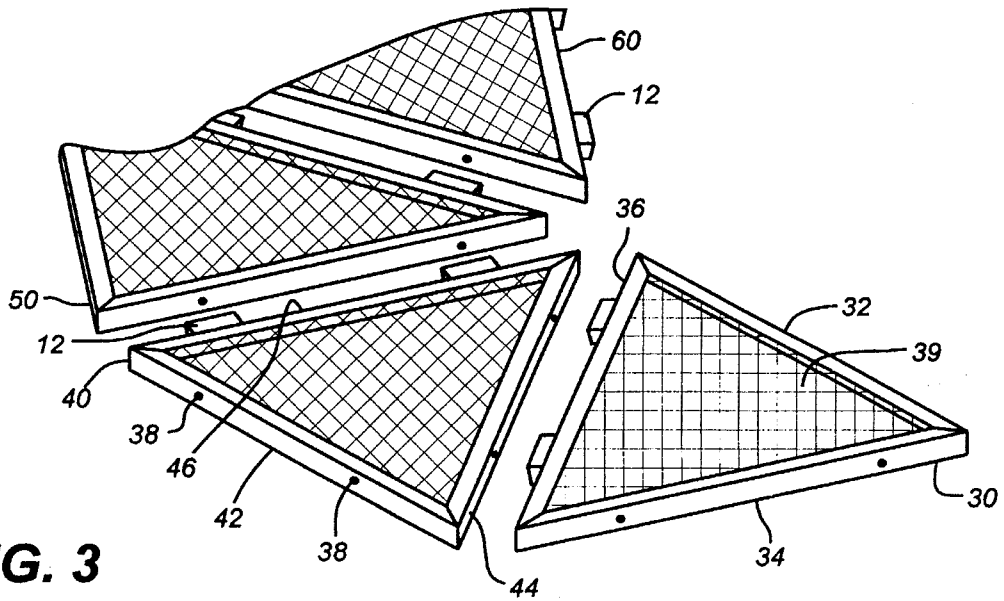
FIG. 3 is an isometric view of an embodiment of the invention.

Another apparatus embodiment of the present invention relates to triangular members for assembly into a geodesic dome. As shown in FIG. 3, each triangular member comprises three perimeter members 32,34,36 joined together at their respective ends to form a triangle. Each of the perimeter members comprises two bolt channels 38 spaced apart such that each bolt channel is located in the vicinity of an end of the perimeter member. Each perimeter member is oriented so that one of its surfaces faces the inside of the triangle and its other surface faces away from the triangle. A wire mesh 39 is attached to each perimeter member such that it covers the surface area of the triangle.

Two wedged central angled spacer sleeves are attached to one of the perimeter members of the triangle. This attachment may be accomplished by welding 96 the central angled spacer sleeves to the perimeter member. Each central angled spacer sleeve comprises a bolt channel with a diameter that is substantially equivalent to the diameter of the perimeter member bolt channels. Each central angles spacer sleeve faces away from the triangle and is positioned such that its bolt channel is aligned with a bolt channel in one of the perimeter members to which it is attached, as shown in FIG. 3.

In a preferred embodiment, additional bolt channels are added to each perimeter member on a case-by-case basis. In the same preferred embodiment, a third wedged central angled spacer sleeve is aligned with the central bolt channel in the perimeter member to which the other two central angled spacer sleeves are attached. In another preferred embodiment, each perimeter member is made of angle iron. The wire mesh may be welded 98 to each perimeter member. The wire mesh may be made from woven wire.

Figure 5:
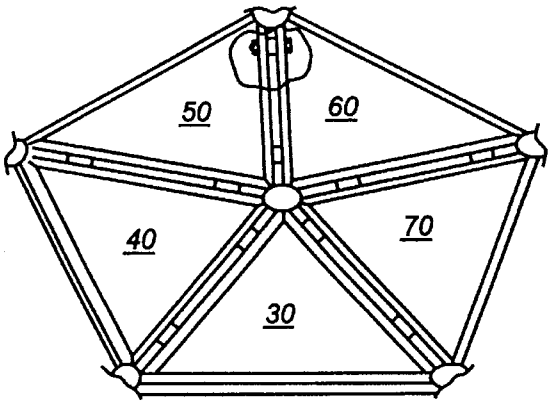
FIG. 5 is an isometric view of a hexagonal embodiment of the present invention.
Figure 4:
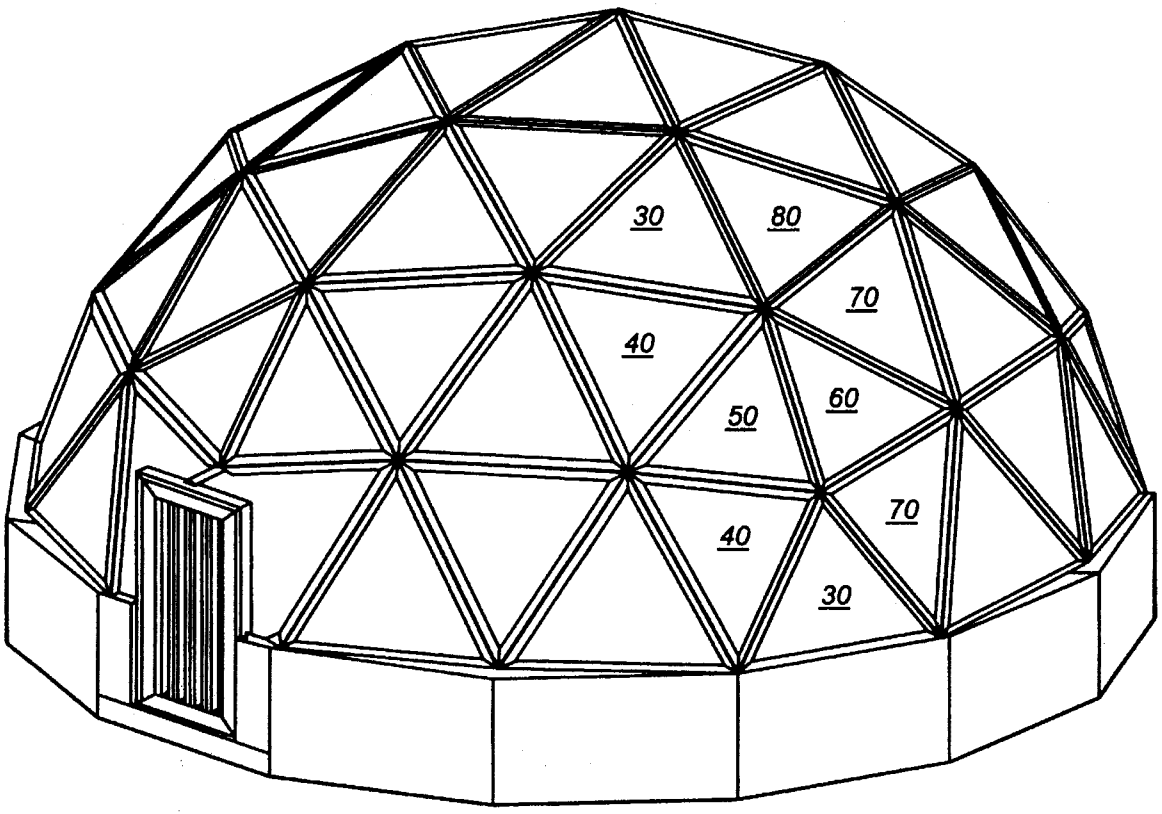
FIG. 4 is an isometric view of a geodesic dome embodiment of the invention.

In another embodiment of the present invention, multiple triangular members of the type described above are joined together to form a curved surface for use in applications such as the construction of a geodesic dome, as shown in FIGS. 3–5. For ease of identification, the triangle described above is hereinafter referred to as the "first triangle" 30.

In this embodiment of the invention, a second triangle 40 comprising three perimeter members 42,44,46, two wedged central angled spacer sleeves 12, and a wire mesh 39, Joined together as in the first triangle, is placed in contact with the central angled spacer sleeves of the first triangle such that the bolt channels of perimeter member 44 of the second triangle are aligned with the bolt channels of the central angled spacer sleeves of the first triangle. The second triangle is positioned such that its central angled spacer sleeves face away from the first triangle.

Two bolts comprising a head having a diameter larger than the diameter of the bolt channels and a threaded end opposite the head of the bolt extend through a set of central angled spacer sleeves and perimeter member bolt channels, as shown in FIG. 5. A bolt head bevel washer comprising a channel of substantially equivalent diameter to the bolt channels of the perimeter members is positioned between one of the bolt heads and one of the perimeter members such that a bolt extends through the bolt channel in each bolt head bevel washer. In an embodiment of the invention wherein each perimeter member contains two bolt channels, two bolt head bevel washers will be used.

A threaded nut is threaded onto the threaded end of each bolt. A wedged nut bevel washer comprising a bolt channel of substantially equivalent diameter to the bolt channel of the perimeter members is positioned between one of the nuts and one of the perimeter members such that the threaded end of one of the bolts extends through the bolt channel in a nut bevel washer, as shown in FIG. 5.

In one embodiment, the dimensions of the triangles are such that when five triangles are connected side-by-side in the same manner that the first and second triangle are connected, they form a pentagon. As shown in FIGS. 4 and 5, such a pentagon configuration has applications to the construction of a geodesic dome. In other applications, the triangles are sized such that when six triangles are connected side-by-side in the same manner that the first and second triangles are connected, they form a hexagon.

A hexagon configuration also has applications to the construction of a geodesic dome, as shown in FIG. 4. In a geodesic dome embodiment, the preferred angle of curvature resulting from the joining of two adjacent triangles is 12°.

In another embodiment of the present invention, a third triangle 50 comprising three perimeter members, two wedged angled spacer sleeves, and a wire mesh, joined together as in the first triangle, is bolted to the second triangle in the same manner and with the same components that the second triangle is bolted to the first triangle, as shown in FIG. 5. The third triangle is positioned such that its central angled spacer sleeves face away from the second triangle.

A fourth triangle 60 comprising the same elements arranged in the same configuration as the third triangle is bolted to the third triangle in the same manner and with the same components that the third triangle is bolted to the second triangle, as shown in FIG. 5.

A fifth triangle 70 comprising the same elements arranged in the same configuration as the fourth triangle is bolted to the fourth triangle in the same manner and with the same components that the fourth triangle is bolted to the third triangle. In a preferred embodiment, the perimeter members of these five triangles are sized such that these triangles form a pentagon, as shown in FIG. 5.

In another embodiment of the invention, a sixth triangle 80 comprising the same elements arranged in the same configuration as the fifth triangle is bolted to the fifth triangle in the same manner and with the same components that the fifth triangle is bolted to the fourth triangle. In this preferred embodiment, the perimeter members of these six triangles are sized such that these triangles form a hexagon.

It is evident to one of skill in the art that by varying the lengths of the perimeter members, the angles of each triangle can be varied. By varying the lengths and the angles of the triangles, one can vary whether the triangles can be assembled to form a hexagon or a pentagon. It is even possible to vary the lengths of the perimeter members such that the triangles can be assembled to form polygons with more than six sides.

In a preferred embodiment, the perimeter members can be integrally formed with central angled spacer sleeves, bolt head bevel washers, and/or nut bevel washers as described for the wall segment and shims. This integral formation can be accomplished by casting or by injection molding.

Many modifications and variations may be made in the embodiments described herein and depicted in the accompanying drawings without departing from the concept of the present invention. Accordingly, it is clearly understood that the embodiments described and illustrated herein are illustrative only and are not intended as a limitation upon the scope of the present invention.

What is claimed is:

1. An apparatus for use in assembling multiple wall segments into a curved configuration, comprising:

(a) a first wall segment comprising opposite ends and two bolt channels of substantially equivalent diameter in the vicinity of each end;

(b) two wedged central angled spacer sleeves, each of said central angled spacer sleeves comprising a bolt channel with a diameter substantially equivalent to the diameter of said first wall segment bolt channels, each of said central angled spacer sleeves welded to said first wall segment such that the bolt channel of each central angled spacer sleeve is aligned with a bolt channel of said first wall segment;

(c) a second wall segment comprising opposite ends and two bolt channels of substantially equivalent diameter to the bolt channels in said first wall segment, said bolt channels being located in the vicinity of each end, said second wall segment positioned against said central angled spacer sleeves such that each bolt channel in said second wall segment is aligned with a bolt channel in said first wall segment;

(d) a bolt extending through each set of aligned bolt channels in the vicinity of each end of said first and second wall segments, said bolt comprising a head, having an outer radial dimension greater than the diameter of said bolt channels, and a threaded end opposite the end of said bolt from said head;

(e) a wedged bolt head bevel washer comprising a bolt channel of substantially equivalent diameter to the bolt channels of said wall segments, said bolt head bevel washer positioned between said bolt head and one of said wall segments such that said bolt extends through the bolt channel in said bolt head bevel washer;

(f) a nut threaded onto the threaded end of said bolt; and (g) a wedged nut bevel washer comprising a bolt channel of substantially equivalent diameter to the bolt channels of said wall segments said nut bevel washer positioned between said nut and the remaining wall segment such that the threaded end of said bolt extends through the bolt channel in said nut bevel washer.

2. The apparatus of claim 1 wherein said bolt head bevel washers and said nut bevel washers are rotationally aligned such that their thicker outer surfaces are in substantially the same azimuth, relative to the radial center of each bolt passing through said bolt head and nut bevel washers.

3. The apparatus of claim 2 wherein said bolt head bevel washers are rotationally aligned 180 degrees out of rotational alignment from said central angled spacer sleeves relative to the radial center of each bolt passing through said bolt head and central angled spacer sleeves.

4. The apparatus of claim 3 wherein the dimensions and shapes of said bolt head bevel washers, central angled spacer sleeves and nut bevel washers are such that when said nuts are tightened, maximum flush surface contact exists between said bolt heads and said bolt head bevel washers and between said nuts and said nut bevel washers.

5. The apparatus of claim 1 wherein said nuts are tightened onto said bolt such that rotational movement of said bolt head bevel washers and said nut bevel washers does not occur.

6. The apparatus of claim 1 wherein said wall segments are made of angle iron.

7. A triangular member for assembly comprising:

(a) three perimeter members joined together at their respective ends to form a first triangle, each of said perimeter members comprising two bolt channels spaced apart such that each bolt channel is located in the vicinity of an end of said perimeter member, each of said perimeter members oriented such that one of its surfaces faces the inside of the first triangle while its other surface faces away from the first triangle;

(b) wire mesh attached to each perimeter member such that it covers the surface area of the first triangle; and (c) two wedged central angled spacer sleeves welded to one of said perimeter members, each of said central angled spacer sleeves comprising a bolt channel with a diameter substantially equivalent to the diameter of said perimeter member bolt channels, each of said central angled spacer sleeves facing away from the first triangle, and each of said central angled spacer sleeves being positioned such that its bolt channel is aligned with a bolt channel in the perimeter member to which it is attached.

8. The apparatus of claim 7, wherein said perimeter member is made from angle iron.

9. The apparatus of claim 7, wherein said wire mesh is welded to each of said perimeter members.

10. The apparatus of claim 7, wherein said wire mesh is made from woven wire.

11. A method for assembling a first and second wall segment, each comprising two bolt channels of substantially equivalent diameter, into a curved configuration, comprising the steps of:

(a) welding a first wedged central angled spacer sleeve comprising a bolt channel of substantially equivalent diameter to the bolt channels of the wall segments, to the first wall segment such that the bolt channel of the sleeve is aligned with one of the bolt channels on the first wall segment;

(b) welding a second wedged central angled spacer sleeve comprising a bolt channel of substantially equivalent diameter to the bolt channels of the wall segments, to the first wall segment such that the bolt channel of the sleeve is aligned with another bolt channel on the first wall segment;

(c) placing the second wall segment into contact with the first and second central angled spacer sleeves such that the bolt channels on the second wall segment are aligned with the bolt channels of the central angled spacer sleeves and the first wall segment;

(d) placing a wedged bolt head bevel washer comprising a bolt channel of substantially equivalent diameter to the bolt channels of the wall segments, against the outer surface of the second wall segment such that the bolt channel in the bolt head bevel washer is aligned with the bolt channels in the first and second wall segments and one of the central angled spacer sleeves;

(e) inserting a bolt having a diameter slightly less than the bolt channel diameter of the bolt head bevel washer through the bolt channels of the bolt head bevel washer, second wall segment, angled spacer sleeve and first wall segment, such that the underside of the bolt head is in contact with the bolt head bevel washer;

(f) inserting a wedged nut bevel washer comprising a bolt channel of substantially equivalent diameter to the bolt channels of the wall segments, over the end of the bolt and against the outer surface of the first wall segment;

(g) threading a nut onto the end of the bolt and tightening the nut to a point where rotation of the bolt head bevel washer and nut bevel washer are still possible;

(h) ensuring that the bolt head bevel washer and nut bevel washer are rotationally oriented such that the nut can be tightened to provide maximum flush surface contact between the bolt head and the bolt head bevel washer and between the nut and the nut bevel washer; and (i) repeating steps d–h for each remaining set of aligned wall segment and central angled spacer sleeve bolt channels.

12. The method of claim 11 further comprising the step of tightening the nut such that rotational movement of the bolt head bevel washer and nut bevel washer do not occur.

* * * * *

UNITED STATES PATENT AND TRADEMARK OFFICE

CERTIFICATE OF CORRECTION

PATENT NO. : 5,452,555
DATED : September 26, 1995
INVENTOR(S) : Lee

It is certified that error appears in the above-indentified patent and that said Letters Patent is hereby corrected as shown below:

Column 1, line 5, please insert -- This invention was made with Government support under NIH Grant # 2 U42 RR03509-06, awarded by the National Institutes of Health. The Government has certain rights in the invention. --

Signed and Sealed this

Twenty-third Day of January, 1996

*Attest:*

Bruce Lehman

BRUCE LEHMAN

*Attesting Officer*

*Commissioner of Patents and Trademarks*